US010938096B1

(12) United States Patent
Byers

(10) Patent No.: US 10,938,096 B1
(45) Date of Patent: Mar. 2, 2021

(54) MULTI-RESONANT ANTENNA

(71) Applicant: HONEYWELL FEDERAL MANUFACTURING & TECHNOLOGIES, LLC, Kansas City, MO (US)

(72) Inventor: Kyle J. Byers, Kansas City, MO (US)

(73) Assignee: Honeywell Federal Manufacturing & Technologies, LLC, Kansas City, MO (US)

( * ) Notice: Subject to any disclaimer, the term of this patent is extended or adjusted under 35 U.S.C. 154(b) by 0 days.

(21) Appl. No.: 16/228,883

(22) Filed: Dec. 21, 2018

(51) Int. Cl.

| | |
|---|---|
| ***H01Q 1/52*** | (2006.01) |
| ***H01Q 1/36*** | (2006.01) |
| ***H01Q 9/06*** | (2006.01) |
| ***H01Q 5/335*** | (2015.01) |

(52) U.S. Cl.
CPC ..... *H01Q 1/362* (2013.01); *H01Q 1/52* (2013.01); *H01Q 5/335* (2015.01); *H01Q 9/06* (2013.01)

(58) Field of Classification Search
CPC ..... H01Q 1/362; H01Q 5/335; H01Q 1/52; H01Q 9/06
See application file for complete search history.

(56) References Cited

U.S. PATENT DOCUMENTS

| | | | |
|---|---|---|---|
| 2,676,257 | A | 4/1954 | Lebenstreit |
| 6,337,664 | B1 | 1/2002 | Mayes et al. |
| 7,777,685 | B2 | 8/2010 | Stuart |
| 7,898,493 | B1 | 3/2011 | Rojas et al. |
| 8,188,932 | B2 | 5/2012 | Worl et al. |
| 8,378,920 | B2 | 2/2013 | Shlager et al. |
| 8,810,466 | B2 | 8/2014 | Sciré-Scappuzzo et al. |
| 9,263,803 | B1 | 2/2016 | Weller et al. |
| 2015/0130665 | A1 | 5/2015 | Lacaze et al. |

*Primary Examiner* — Graham P Smith
(74) *Attorney, Agent, or Firm* — Hovey Williams LLP

(57) ABSTRACT

A multi-resonant, electrically-small antenna having a first helical arm and a second helical arm. The first helical arm encircles a first central axis and includes a proximal end. A radius between the first helical arm and the first central axis decreases in a distal direction away from the proximal end of the first helical arm. The second helical arm is nested in the first helical arm and encircles a second central axis. The second helical arm also includes a proximal end. A radius between the second helical arm and the second central axis decreases in a distal direction away from the proximal end of the second helical arm.

20 Claims, 3 Drawing Sheets

MULTI-RESONANT ANTENNA

STATEMENT REGARDING FEDERALLY-SPONSORED RESEARCH OR DEVELOPMENT

This invention was made with Government support under Contract No.: DE-NA0002839 awarded by the United States Department of Energy/National Nuclear Security Administration. The Government has certain rights in the invention.

BACKGROUND

Antennas are used in communication systems of devices such as global positioning systems (GPS), telecommunication systems, cellular systems, radio systems, transceivers, transmitters, receivers, Bluetooth® and Wifi systems, etc. The sizes and shapes of antennas are often a function of frequency requirements, power needs, radiation patterns, etc.

Communication systems often require a wide bandwidth and/or multiple operating bands. One way to accomplish a wider bandwidth or multiple operating bands is to use multiple antennas. However, for various design and application-related reasons, such as portability, battery size, component complexity, etc., multiple antennas are not practical. Further, multiple antennas in proximity cause electromagnetic interference problems.

The background discussion is intended to provide information related to the present invention which is not necessarily prior art.

SUMMARY

The present invention solves the above-described problems and other problems by providing a compact, multi-resonant, electrically-small antenna having multiple resonant structures that widen the bandwidth and enable multiple operating bands while causing minimal electromagnetic interference.

A multi-resonant, electrically-small antenna constructed in accordance with an embodiment of the present invention comprises a first helical arm and a second helical arm. The first helical arm encircles a first central axis and has a proximal end and a distal end. A radius between the first helical arm and the first central axis decreases in a distal direction away from the proximal end toward the distal end.

The second helical arm is nested in the first helical arm and encircles a second central axis and includes a proximal end and a distal end. A radius between the second helical arm and the second central axis decreases in a distal direction away from the proximal end. The second helical arm provides additional bandwidth and/or enables multiple operating bands. The nesting of the second helical arm within the first helical arm uses space more efficiently than adding additional resonant structures and/or antennas outside the first helical arm. In some embodiments, the second helical arm may encircle the second central axis in a direction opposite to the first helical arm, thereby reducing electromagnetic interference and/or reducing the metallic loading.

Another embodiment of the invention is a multi-resonant, electrically-small antenna comprising a first helical arm and a second helical arm nested in the first helical arm. The first helical arm has a distal end and a proximal region and encircles a first central axis. A radius between the first helical arm and the first central axis increases in a direction away from the distal end to the proximal region and thereafter decreases in a direction away from the proximal region.

The second helical arm is nested in the first helical arm and includes a distal end and a proximal region. The second helical arm encircles a second central axis. A radius between the second helical arm and the second central axis increases in a direction away from the distal end to the proximal region and thereafter decreases in a direction away from the proximal region. The first and second helical arms of this embodiment may form spherical shapes, which provide improved electrical performance and efficiency.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
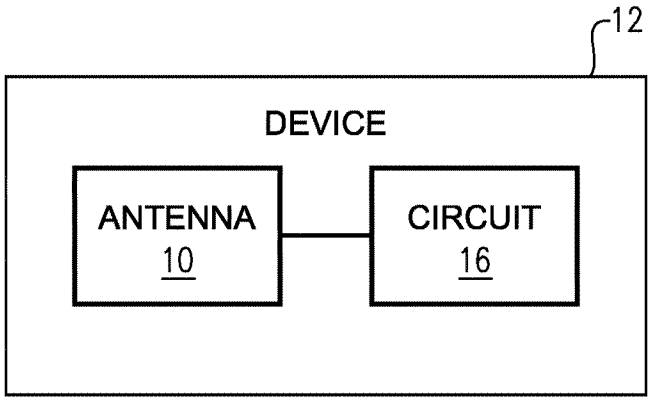
FIG. 1 is a schematic view of a device having an exemplary antenna constructed in accordance with embodiments of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment," "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning to FIG. 1, a multi-resonant antenna 10 constructed in accordance with an embodiment of the invention is depicted as being enclosed inside a device 12. The device 12 may be a cell phone, laptop, desktop computer, transceiver, receiver, transmitter or any other device which uses an antenna for communication.

The antenna 10 is configured to transmit and/or receive electromagnetic radiation, such as GPS signals, radio signals, cellular signals, Bluetooth® signals, Wifi signals, and/or the like. The antenna 10 may be an electrically-small antenna having a height or length that is significantly shorter than a wavelength of a signal that the antenna 10 is configured to transmit and/or receive. This is represented by Equation 1 below where 'h' represents the height of the antenna 10, and 'A' represents the wavelength of the signal.

$$h \ll \frac{\lambda}{2\pi} \tag{1}$$

Figure 2:
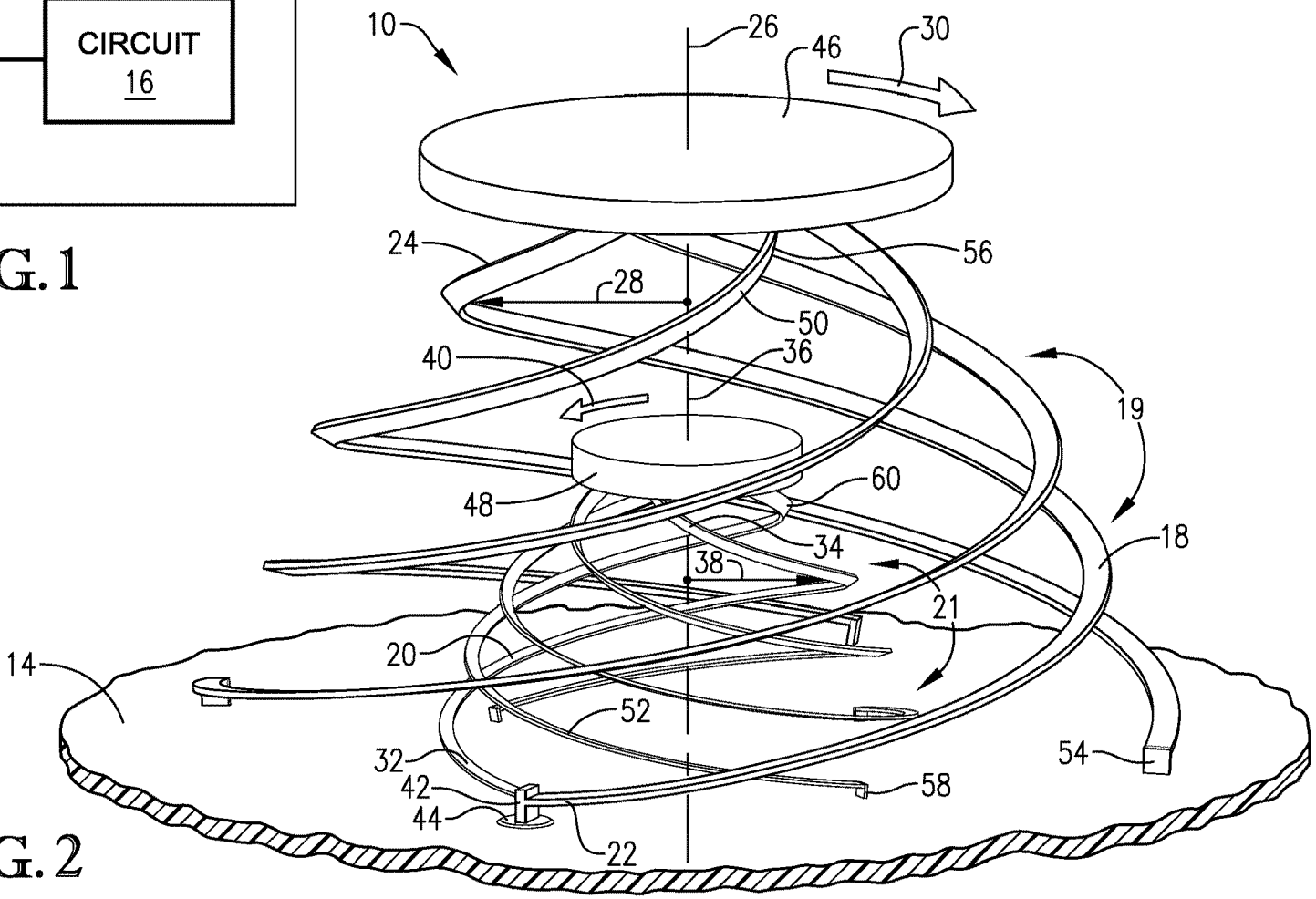
FIG. 2 is a front perspective view of the antenna of FIG. 1.

The antenna 10 may be enclosed in the device 12 and supported on a proximal support surface 14 (shown in FIG. 2). The proximal support surface 14 may be a portion of a circuit board or a portion of a housing of the device 12. The antenna 10 may be connected to a circuit 16, such as a GPS system, a telecommunication system, a cellular system, a radio system, a transceiver, a transmitter, a receiver, a Bluetooth® system, a Wifi system, and/or the like.

As depicted in FIG. 2, the antenna 10 comprises a first helical arm 18 and a second helical arm 20 nested in the first helical arm 18. The first helical arm 18 forms a first resonant structure 19 and is provided for transmitting and/or receiving a signal having a first frequency, frequency band, and/or resonance. The first helical arm 18 includes a proximal end 22 and a distal end 24 and encircles a first central axis 26. The first helical arm 18 may encircle the first central axis 26 in a first direction 30, which may be in a partially clockwise or counter-clockwise direction about the first central axis 26. A radius 28 between the first helical arm 18 and the first central axis 26 decreases in a distal direction away from the proximal end 22 of the first helical arm 18.

A height of the first helical arm 18 may determine the first frequency and/or frequency band of the signal. For example, the height of the first helical arm 18 may be significantly shorter than a wavelength of the signal so that the first helical arm 18 would independently operate like an electrically-small antenna. The first helical arm 18 may form a semicircular, parabolic, or otherwise curved profile.

The second helical arm 20 forms a second resonant structure 21 and is provided for transmitting and/or receiving a signal having a second frequency and/or frequency band. The second helical arm 20 includes a proximal end 32 and a distal end 34 and encircles a second central axis 36. The second helical arm 20 may encircle the second central axis 36 in a second direction 40. The second direction 40 may be in a partially clockwise or counter-clockwise direction about the second central axis 36 and may be opposite to the first direction 30. By encircling the respective axes 26, 36 in opposite directions, the first and second helical arms 18, 20 reduce electromagnetic interference that they would otherwise impose on each other. The second central axis 36 may or may not be aligned with the first central axis 26. A radius 38 between the second helical arm 20 and the second central axis 36 decreases in a distal direction away from the proximal end 32 of the second helical arm 20.

A height of the second helical arm 20 may determine the second frequency and/or frequency band of the signal. For example, the height of the second helical arm 20 may be significantly shorter than a wavelength of the signal so that the second helical arm 20 may also independently operate like an electrically-small antenna. The height of the second helical arm 20 may be shorter than the height of the first helical arm 18, and therefore the second frequency and/or frequency band would be higher than the first frequency and/or frequency band. For example, the first frequency and/or frequency band of the first helical arm 18 may be below 2 GHz, and the second frequency and/or frequency band of the second helical arm 20 may be above 2 GHz. The second helical arm 20 may also form a semicircular, parabolic, or otherwise curved profile.

The antenna 10 may further comprise a connector 42 for physically and/or electrically connecting the first helical arm 18 to the second helical arm 20. The connector 42 may be attached to the proximal end 22 of the first helical arm 18 and the proximal end 32 of the second helical arm 20. The connector 42 may further be attached to the proximal support surface 14, thereby securing the antenna 10 to the surface 14. The connector 42 may electrically connect the antenna 10 to the circuit 16 and/or to a radio frequency (RF) port 44. The antenna 10 may include any number of resonant structures without departing from the scope of the present invention. The additional resonant structures may be nested inside either of the resonant structures 19, 21, or the resonant structures 19, 21 may be nested inside the additional resonant structures. The additional resonant structures may also connect to the connector 42 and having alternating winding directions. Each additional resonant structure may provide an additional resonance, frequency/frequency band, and/or another electrical characteristic.

The antenna 10 may further comprise a first disc 46, a second disc 48, a third helical arm 50, and a fourth helical arm 52. The first and second discs 46, 48 are provided for connecting a plurality of arms together. The first and second discs 46, 48 may be any material that physically and/or electrically connects the distal ends of one or more helical arms.

The third helical arm 50 may be provided for achieving better electrical performance, such as increased efficiency, reducing impedance, impedance matching, and/or changing other electrical characteristics. The third helical arm 50 may be substantially similar to the first helical arm 18 and together form the first resonant structure 19. The third helical arm 50 includes a proximal end 54 and a distal end 56. The third helical arm 50 encircles the first central axis 26 so that the radius 28 between the third helical arm 50 and the first central axis 26 decreases in a distal direction away from the proximal end 54 of the third helical arm 50, similar to the first helical arm 18. The third helical arm 50 may also encircle the first central axis 26 in the first direction 30, or the same direction as the first helical arm 18. The third helical arm 50 may also be configured to transmit and/or receive a signal having the first frequency and/or frequency band.

The fourth helical arm 52 may also be provided for better electrical performance, such as increased efficiency, reducing impedance, impedance matching, and/or changing other electrical characteristics. The fourth helical arm 52 may be substantially similar to the second helical arm 20 and together form the second resonant structure 21. The fourth helical arm 52 is nested inside the first and third helical arms 18, 50. The fourth helical arm 52 may include a proximal end 58 and a distal end 60. The fourth helical arm 52 encircles the second central axis 36 so that the radius 38 between the fourth helical arm 52 and the second central axis 36 decreases in a distal direction away from the proximal end 58 of the fourth helical arm 52. The fourth helical arm 52 may also encircle the second central axis 36 in the second direction 40, or in the same direction as the second helical arm 20. The fourth helical arm 52 may also be configured to transmit and/or receive a signal having the second frequency and/or frequency band.

The distal ends 24, 56 of the first and third helical arms 18, 50 may be physically and/or electrically connected to the first disc 46. The distal ends 34, 60 of the second and fourth helical arms 20, 52 may be physically and/or electrically connected to the second disc 48. While FIG. 2 depicts the antenna 10 having six helical arms, three in the first resonant structure 19 and three in the second resonant structure 21, the antenna 10 may include any number of helical arms attached to either the first or second discs 46, 48 without departing from the scope of the present invention. For example, the antenna 10 may have three helical arms attached to the first disc 46 and only one arm attached to the second disc 48. Alternatively, the antenna 10 may have only one helical arm attached to the first disc 46 and three helical arms attached to the second disc 48. In some embodiments, the antenna 10 may be made out of conductive material such as metal or conductive carbon material. The antenna 10 may include any number of resonant structures without departing from the scope of the present invention. The additional resonant structures may be nested inside either of the resonant structures 19, 21, or the resonant structures 19, 21 may be nested inside the additional resonant structures. The additional resonant structures may also connect to the connector 42. The additional resonant structures may also connect to the connector 42 and having alternating winding directions. Each additional resonant structure may provide an additional resonance, frequency/frequency band, and/or another electrical characteristic. Further, the antenna 10 may include a coating of titanium alloy, such as Ti-6Al-4V, or TC4.

In use, the antenna 10 may receive a signal having a frequency that the first helical arm 18 and/or the second helical arm 20 is configured to receive. Additionally or alternatively, the first and second helical arms 18, 20 may together be configured to receive a signal within a frequency band. The antenna 10 may be configured to pass the received signal to the circuit 16. Additionally or alternatively, the circuit 16 may pass a signal to be transmitted to the antenna 10. The signal may be transmitted by the first helical arm 18 and/or the second helical arm 20.

Figure 3:
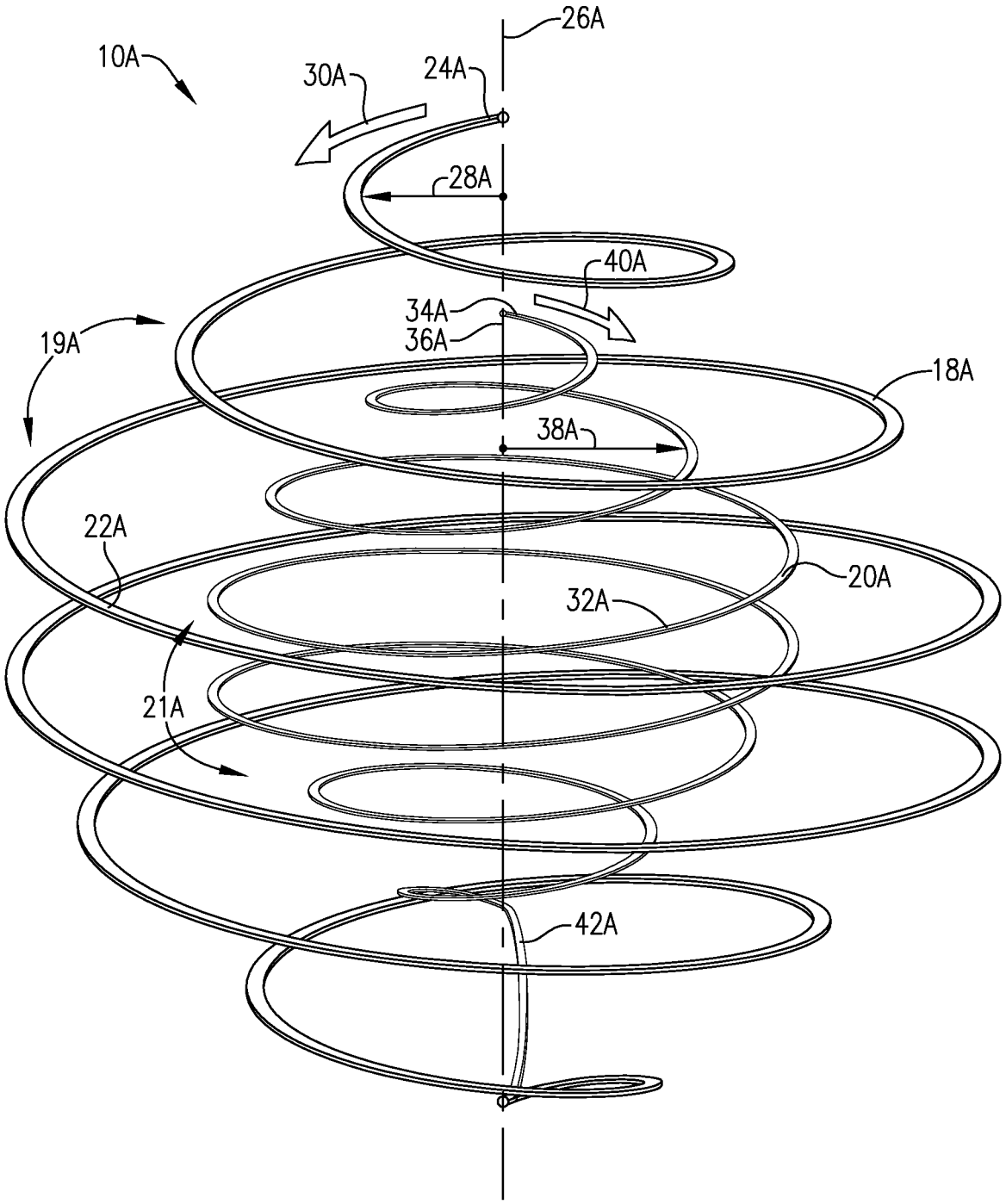
FIG. 3 is a front perspective view of an antenna constructed in accordance with another embodiment of the invention.

An antenna 10A constructed in accordance with another embodiment of the invention is shown in FIG. 3. The components of antenna 10A that correspond to similar components in antenna 10 have an 'A' appended to their reference numerals. The antenna 10A may comprise substantially similar components as antenna 10, except that its helical arms 18A, 20A form a relatively spherical profile for improved electrical performance.

The helical arms 18A, 20A of antenna 10A have distal ends 24A, 34A and proximal regions 22A, 32A. The first helical arm 18A forms a first resonant structure 19A and encircles the first central axis 26A so that the radius 28A between the first helical arm 18A and the first central axis 26A increases in a proximal direction away from its distal end 24A to its proximal region 22A and thereafter decreases in a distal direction away from its proximal region 22A.

A height and/or rotation angle of the first helical arm 18A may determine the desired frequency and/or desired frequency band of a signal. For example, the height of the first helical arm 18A may be significantly shorter than a wavelength of the signal so that the first helical arm 18A would operate like an electrically-small antenna. The first helical arm 18A may form a spherical, oblong, or elongated profile.

The second helical arm 20A forms a second resonant structure 21A and is nested in the first helical arm 18A and encircles the second central axis 36A so that the radius 38A between the second helical arm 20A and the second central axis 36A increases in a proximal direction away from its distal end 34A to its proximal region 32A and thereafter decreases in a distal direction away from its proximal region 32A.

A height and/or rotation angle of the second helical arm 20A may determine the desired frequency and/or desired frequency band of the signal. For example, the height of the second helical arm 20A may be significantly shorter than a wavelength of a signal so that the second helical arm 20A would operate like an electrically-small antenna. The height of the second helical arm 20A may be shorter than the height of the first helical arm 18A and therefore its desired frequency and/or frequency band would be higher. For example, the desired frequency of the first helical arm 18A may be below 2 GHz, and the desired frequency of the second helical arm 20A may be above 2 GHz. The second helical arm 20A may also form a spherical, oblong, or elongated profile. A connector 42A may physically and/or electrically connect the first helical arm 18A to the second helical arm 20A. Additionally, the antenna 10A may include additional resonant structures nested in the first resonant structure 19A and/or the second resonant structure 21A, and/or additional resonant structures that the first resonant structure 19A is nested in. The antenna 10A may include any number of resonant structures to achieve any number of resonances, frequencies/frequency bands, and/or other electrical characteristics. Each additional resonant structure may provide an additional resonance, frequency/frequency band, and/or another electrical characteristic. The additional resonant structures may also connect to the connector 42A and having alternating winding directions.

In use, the antenna 10A may receive a signal having a frequency that the first helical arm 18A and/or the second helical arm 20A is configured to receive. Additionally or alternatively, the first and second helical arms 18A, 20A may together be configured to receive a signal within a frequency band. The antenna 10A may be configured to pass the received signal to a circuit. Additionally or alternatively, the circuit may pass a signal to be transmitted to the antenna 10A. The signal may be transmitted by the first helical arm 18A and/or the second helical arm 20A.

Figure 4:
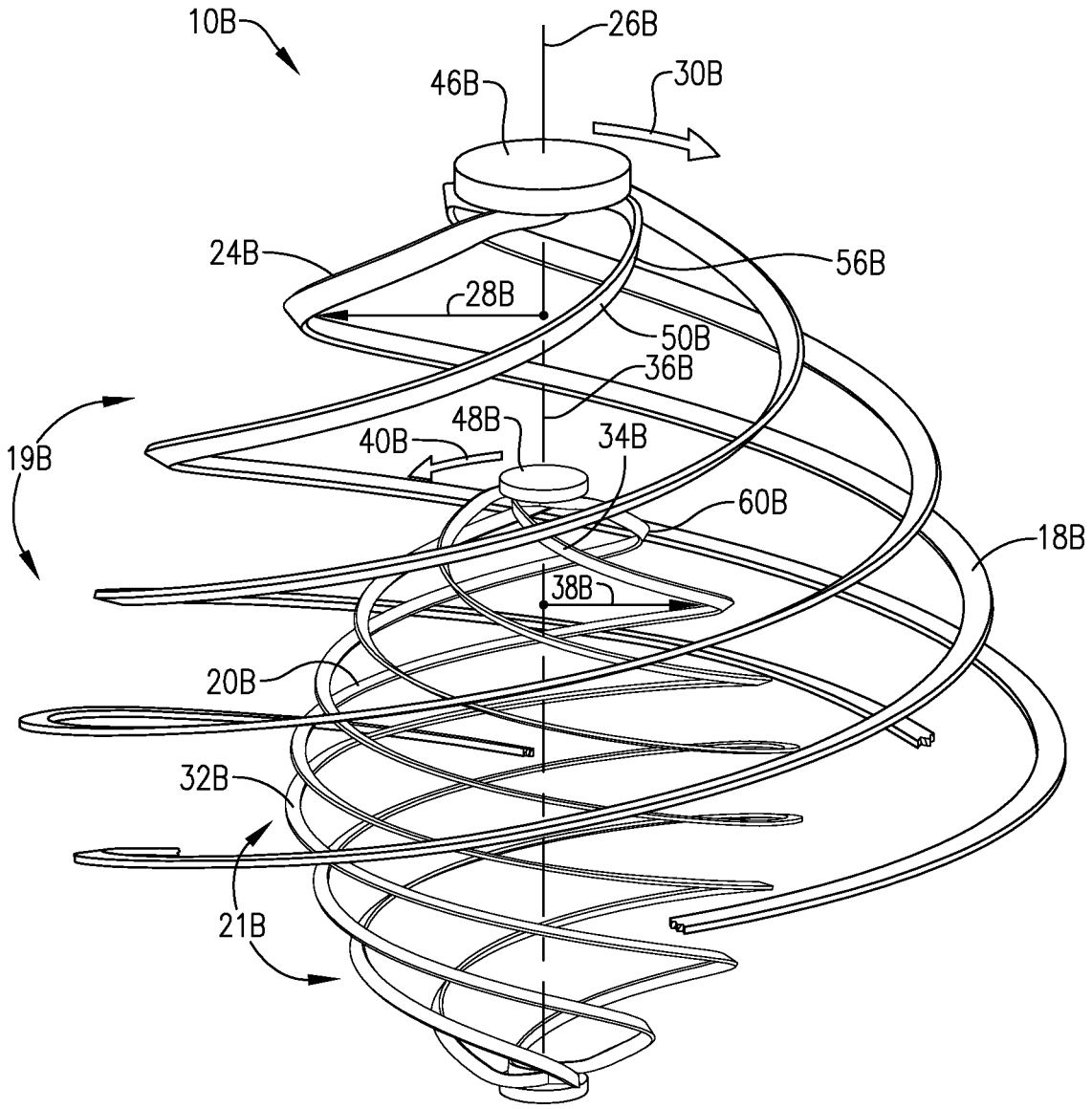
FIG. 4 is a front perspective view of an antenna constructed in accordance with another embodiment of the invention.

An antenna 10B constructed in accordance with another embodiment of the invention is shown in FIG. 4 with a lower portion of the outer helical arms of the antenna 10B being cut away to show the inner portion. The components of antenna 10B that correspond to similar components in antenna 10A have a 'B' appended to their reference numerals. The antenna 10B may comprise substantially similar components as antenna 10A, except that it includes additional helical arms, a third helical arm 50B and a fourth helical arm 52B, for providing improved electrical performance.

The helical arms 18B, 20B, 50B, 52B of antenna 10B have distal ends 24B, 34B, 56B, 60B and proximal regions 22B, 32B, 54B, 58B. The first and third helical arms 18B, 50B form a first resonant structure 19B and encircle the first central axis 26B so that the radius 28B between the first and third helical arms 18B and the first central axis 26B increases in a proximal direction away from their distal ends 24B, 56B to their proximal regions 22B, 54B and thereafter decreases in a distal direction away from their proximal regions 22B, 54B.

A height of the first and third helical arms 18B, 50B may determine the desired frequency and/or desired frequency band of a signal. For example, the height of the first and third helical arms 18B, 50B may be significantly shorter than a wavelength of the signal so that the first and third helical arms 18B, 50B would operate like an electrically-small antenna. The first and third helical arms 18B, 50B may form a spherical, oblong, or elongated profile.

The second and fourth helical arms 20B, 52B are nested in the first and third helical arms 18B, 50B and form a second resonant structure 21B. The second and fourth helical arms 20B, 52B encircle the second central axis 36B so that the radius 38B between the second and fourth helical arms 20B, 52B and the second central axis 36B increases in a proximal direction away from their distal ends 34B, 60B to their proximal regions 32B, 58B and thereafter decreases in a distal direction away from their proximal regions 32B, 58B.

A height of the second and fourth helical arms 20B, 52B may determine the desired frequency and/or desired frequency band of the signal. For example, the height of the second and fourth helical arms 20B, 52B may be significantly shorter than a wavelength of a signal so that the second and fourth helical arms 20B, 52B would operate like an electrically-small antenna. The height of the second and fourth helical arms 20B, 52B may be shorter than the height of the first and third helical arms 18B, 50B and therefore their desired frequency and/or frequency band would be higher. For example, the desired frequency of the first and third helical arms 18B, 50B may be below 2 GHz, and the desired frequency of the second and fourth helical arms 20B, 52B may be above 2 GHz. The second and fourth helical arms 20B, 52B may also form a spherical, oblong, or elongated profile. A connector may physically and/or electrically connect the first helical arm 18B to the second helical arm 20B.

While the helical arms 18B, 20B, 50B, 52B are shown as having a substantially spherical profile in FIG. 4, the helical arms 18B, 20B, 50B, 52B may have different profiles. For example, the first and third helical arms 18B, 50B may form a substantially semispherical profile while the second and fourth helical arms 20B, 52B may form a substantially spherical profile. Alternatively, the first and third helical arms 18B, 50B may form a substantially spherical profile while the second and fourth helical arms 20B, 52B may form a substantially semispherical profile. The profile of the helical arms 18B, 20B, 50B, 52B may be any number of shapes without departing from the scope of the present invention. Additionally, the antenna 10B may include additional resonant structures nested in either of the resonant structures 19B, 21B, and/or additional resonant structures that the resonant structures 19B, 21B are nested in. The antenna 10B may include any number of resonant structures to achieve any number of resonances, frequencies/frequency bands, and/or other electrical characteristics. Each additional resonant structure may provide an additional resonance, frequency/frequency band, and/or another electrical characteristic. The additional resonant structures may also connect to the connector 42B and having alternating winding directions.

In use, the antenna 10B may receive a signal having a frequency that the first and third helical arms 18B and/or the second and fourth helical arms 20B, 52B are configured to receive. Additionally or alternatively, the helical arms 18B, 20B, 50B, 52B may together be configured to receive a signal within a frequency band. The antenna 10B may be configured to pass the received signal to a circuit. Additionally or alternatively, the circuit may pass a signal to be transmitted to the antenna 10B. The signal may be transmitted by the first and third helical arms 18B, 50B and/or the second and fourth helical arms 20B, 52B.

Figure 5:
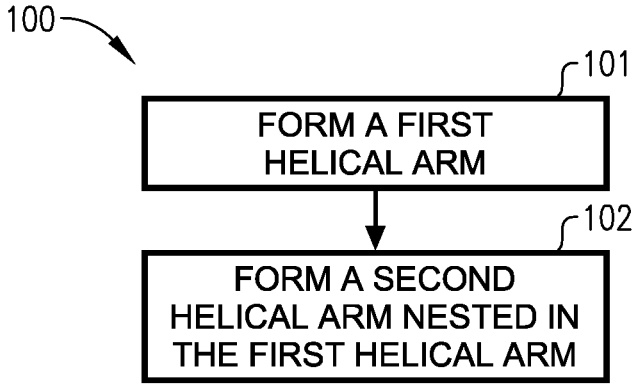
FIG. 5 is a flowchart illustrating at least a portion of the steps for fabricating an antenna constructed in accordance with an embodiment of the invention.

The flow chart of FIG. 5 depicts the steps of an exemplary method 100 of fabricating the antenna 10, the antenna 10*a*, or another antenna. For simplicity, the remaining discussion of the method 100 will reference the antenna 10. In some alternative implementations, the functions noted in the various blocks may occur out of the order depicted in FIG. 5. For example, two blocks shown in succession in FIG. 5 may in fact be executed substantially concurrently, or the blocks may sometimes be executed in the reverse order depending upon the functionality involved. In addition, some steps may be optional.

Referring to step 101, a first helical arm 18 having a proximal end 22 may be formed. The first helical arm 18 may be formed so that the first helical arm 18 encircles a first central axis 26 and a radius 28 between the first helical arm 18 and the first central axis 26 decreases in a distal direction away from the proximal end 22. The first helical arm 18 may be formed so that is has a height that is shorter than a first wavelength. Further, the first helical arm may be formed so that it has a hemispherical, parabolic, oblong, or spherical profile.

Referring to step 102, a second helical arm 20 may be formed inside space defined by the first helical arm 18 so that the second helical arm 20 is nested in the first helical arm 18. The second helical arm 20 may also be formed so that it has a proximal end 32. Further, the second helical arm may be formed so that it encircles a second central axis 36 so that a radius 38 between the second helical arm 20 and the second central axis 38 decreases in a distal direction away from the proximal end 32 of the second helical arm 20.

The second helical arm 20 may be formed so that it has a height that is shorter than a second wavelength, wherein the second wavelength may be shorter than the first wavelength. The second helical arm 20 may also be formed to have a hemispherical, parabolic, oblong, or spherical profile. The first and second helical arms 18, 20 may be formed so that they encircle their respective axes 26, 36 in opposite directions. Further, the first and second central axes 26, 36 may or may not be aligned.

The steps of forming the first and second helical arms 18, 20 may employ additive manufacturing, such as electron beam melting, wherein the arms 18, 20 are formed in layers. The steps of forming the first and second helical arms 18, 20 may occur concurrently so that the second helical arm 20 is formed nested inside the first helical arm 18 as the first helical arm 18 is being formed. Alternatively, the method 100 may include a step of positioning the second helical arm 20 inside a space defined by the first helical arm 18 so that the second helical arm 20 is nested inside the first helical arm 18.

The method 100 may include additional, less, or alternate steps and/or device(s), including those discussed elsewhere herein. For example, the method 100 may include a step of forming a connector that physically and/or electrically connects the first helical arm 18 to the second helical arm 20. Further, the method 100 may include a step of connecting the connector 42 to a radio frequency port 44 via silver epoxy. The method 100 may also include a step of forming additional helical arms 50, 52, as discussed above.

Alternatively, the first helical arm 18A may be formed so that the radius 28A between the first helical arm 18A and the first central axis 26A increases in a proximal direction away from a distal end of the first helical arm 18A to a proximal region 22A of the first helical arm 18A and thereafter decreases in a distal direction away from the proximal region 22A. Further, the second helical arm 20A may be formed so that the radius 38A between the second helical arm 20A and the second central axis 36A increases in a proximal direction away from a distal end 34A of the second helical arm 20A to a proximal region 32A of the second helical arm 20A and thereafter decreases in a distal direction away from the proximal region 32A.

Alternatively, the method 100 may include a step of 3D printing a wax replica of the antenna 10 and then forming a mold using the replica. Then the antenna 10 may be formed using the resulting mold. The wax replica may alternatively be made of other sacrificial material.

The method 100 may also include a step of coating the first and second helical arms 18, 20 with Ti-6Al-4V using, for example, physical vapor deposition. However, the coating may be unnecessary if the first and second helical arms 18, 20 are formed with a non-oxidizing metal.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A multi-resonant, electrically-small antenna comprising:

a first helical arm encircling a first central axis, the first helical arm having a proximal end, a radius between the first helical arm and the first central axis decreasing in a distal direction away from the proximal end; and a second helical arm nested in the first helical arm and encircling a second central axis, the second helical arm having a proximal end, a radius between the second helical arm and the second central axis decreasing in a distal direction away from the proximal end.

2. The multi-resonant, electrically-small antenna of claim 1, wherein a height of the first helical arm is shorter than a first wavelength, and a height of the second helical arm is shorter than a second wavelength that is shorter than the first wavelength.

3. The multi-resonant, electrically-small antenna of claim 1, wherein the first helical arm forms a hemispherical profile.

4. The multi-resonant, electrically-small antenna of claim 1, further comprising an RF port connected to the first and second helical arms.

5. The multi-resonant, electrically-small antenna of claim 1, wherein the first helical arm forms a parabolic profile.

6. The multi-resonant, electrically-small antenna of claim 1, further comprising a Ti-6Al-4V coating on an exterior surface of the first helical arm and the second helical arm.

7. The multi-resonant, electrically-small antenna of claim 1, the first and second helical arms each including a distal end, further comprising a first disc connected to the distal end of the first helical arm, and a second disc connected to the distal end of the second helical arm.

8. The multi-resonant, electrically-small antenna of claim 1, wherein the first helical arm encircles the first central axis in a first direction, and the second helical arm encircles the second central axis in a second direction that is opposite to the first direction.

9. The multi-resonant, electrically-small antenna of claim 1, wherein the first helical arm is configured to receive a signal having a first frequency, and the second helical arm is configured to receive a signal having a second frequency that is higher than the first frequency.

10. The multi-resonant, electrically-small antenna of claim 1, the first helical arm forming a first resonant structure, the second helical arm forming a second resonant structure, further comprising one or more additional resonant structures for enabling additional resonances.

11. The multi-resonant, electrically-small antenna of claim 1, the first and second helical arms each including a distal end, further comprising:

a third helical arm encircling the first central axis, the third helical arm having a proximal end and a distal end, a radius between the third helical arm and the first central axis decreasing in a distal direction away from the proximal end, the distal end of the third helical arm being connected to the distal end of the first helical arm; and a fourth helical arm nested in the third and first helical arms and encircling the second central axis, the fourth helical arm having a proximal end and a distal end, a radius between the fourth helical arm and the second central axis decreasing in a distal direction away from the proximal end, the distal end of the fourth helical arm being connected to the distal end of the second helical arm.

12. A mufti-resonant, electrically-small antenna comprising:

a first helical arm having a distal end and a proximal region, the first helical arm encircling a first central axis, a radius between the first helical arm and the first central axis increasing in a proximal direction away from the distal end to the proximal region and thereafter decreasing in a distal direction away from the proximal region; and a second helical arm nested in the first helical arm, the second helical arm having a distal end and a proximal region, the second helical arm encircling a second central axis, a radius between the second helical arm and the second central axis increasing in a proximal direction away from the distal end to the proximal region and thereafter decreasing in a distal direction away from the proximal region.

13. The multi-resonant, electrically-small antenna of claim 12, wherein the first helical arm encircles the first central axis in a first direction, and the second helical arm encircles the second central axis in a second direction that is opposite to the first direction.

14. The multi-resonant, electrically-small antenna of claim 12, wherein the first helical arm forms a spherical profile.

15. The multi-resonant, electrically-small antenna of claim 12, wherein the first helical arm is configured to receive a signal having a first frequency, and the second helical arm is configured to receive a signal having a second frequency that is higher than the first frequency.

16. The multi-resonant, electrically-small antenna of claim 12, the first and second helical arms each including a disc connected to its distal end.

17. The multi-resonant, electrically-small antenna of claim 16, further comprising:

a first plurality of helical arms, each helical arm having a proximal region and extending from the disc of the first helical arm and encircling the first central axis, a radius between each helical arm and the first central axis increasing in a proximal direction away from the disc of the first helical arm to its respective proximal region and thereafter decreases in a distal direction away from its respective proximal region; and a second plurality of helical arms nested in the first plurality of helical arms, each helical arm having a proximal region and extending from the disc of the second helical arm and encircling the second central axis, a radius between each helical arm and the second central axis increasing in a proximal direction away from the disc of the second helical arm to its respective proximal region and thereafter decreases in a distal direction away from its respective proximal region.

18. A multi-resonant, electrically-small antenna comprising:

a first disc;

a second disc;

a proximal support surface;

a first plurality of helical arms, each helical arm having a distal end connected to the first disc, each helical arm extending from the proximal support surface and encircling a first central axis in a first direction, a radius between each helical arm and the first central axis decreasing in a distal direction away from the proximal support surface; and a second plurality of helical arms nested in the first plurality of helical arms, each helical arm having a distal end connected to the second disc, each helical arm extending from the proximal support surface and encircling a second central axis in a second direction opposite to the first direction, a radius between each helical arm and the second central axis decreasing in a distal direction away from the proximal support surface.

19. The multi-resonant, electrically-small antenna of claim 18, further comprising a connector attached to one of the first plurality of helical arms and to one of the second plurality of helical arms.

20. The multi-resonant, electrically-small antenna of claim 18, wherein the first plurality of helical arms is configured to receive a signal with a first frequency, and the second plurality of helical arms is configured to receive a signal with a second frequency that is higher than the first frequency.

* * * * *